US006921345B2

(12) United States Patent
Higuchi et al.

(10) Patent No.: US 6,921,345 B2
(45) **Date of Patent: *Jul. 26, 2005**

(54) GOLF BALL

(75) Inventors: Hiroshi Higuchi, Chichibu (JP); Atsushi Nanba, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/156,139

(22) Filed: May 29, 2002

(65) Prior Publication Data

US 2003/0013553 A1 Jan. 16, 2003

(30) Foreign Application Priority Data

May 30, 2001 (JP) ..... 2001-163215

(51) Int. Cl.[7] ..... A63B 37/00
(52) U.S. Cl. ..... 473/351; 473/376
(58) Field of Search ..... 473/351, 367, 473/368, 377

(56) References Cited

U.S. PATENT DOCUMENTS

| | | | | |
|---|---|---|---|---|
| 5,816,944 A | * | 10/1998 | Asakura et al. | 473/372 |
| 6,194,505 B1 | * | 2/2001 | Sone et al. | 524/432 |
| 6,786,836 B2 | * | 9/2004 | Higuchi et al. | 473/351 |

FOREIGN PATENT DOCUMENTS

| | | | | |
|---|---|---|---|---|
| EP | 920886 | * | 6/1999 | A63B/37/00 |
| JP | 62-089750 A | | 4/1987 | |
| JP | 63-275356 | | 11/1988 | |
| JP | 02-268778 A | | 11/1990 | |
| JP | 03-151985 A | | 6/1991 | |
| JP | 07-268132 A | | 10/1995 | |
| JP | 11-035633 A | | 2/1999 | |
| JP | 11-070187 A | | 3/1999 | |
| JP | 11-164912 A | | 6/1999 | |
| JP | 11-319148 A | | 11/1999 | |

OTHER PUBLICATIONS

Report of Research & Development, Fine Chemical, vol. 23, No. 9, Jun. 1, 1994, pp. 5–15.

C. Jeff Harlan et al., "Three–Coordinate Aluminum Is Not A Prerequisite for Catalytic Activity in the Zirconocene—Alumoxane Polymerization of Ethylene", American Chemical Society, vol. 117, No. 24, 1995, pp. 6465–6474.

Mark R. Mason et al., "Hydrolysis of Tri–*tert*–butylaluminum: The First Structural Characterization of Alkylalumoxanes $[(R_2Al)_2O]_n$ and $(RAlO)_n$", American Chemical Society, vol. 115, No. 12, 1993, pp. 4971–4984.

* cited by examiner

*Primary Examiner*—Raeann Gorden
(74) *Attorney, Agent, or Firm*—Sughrue Mion, PLLC

(57) ABSTRACT

A golf ball includes a hot-molded product of a rubber composition comprising a base rubber composed of (a) 20–100 wt % of a polybutadiene having a high cis-1,4 content, a minimal 1,2 vinyl content, and a viscosity η of up to 600 mPa·s at 25° C. as a 5 wt % toluene solution, and satisfying a certain relationship between Mooney viscosity and polydispersity index Mw/Mn, in combination with (b) 0–80 wt % of another diene rubber, (c) an unsaturated carboxylic acid, (d) an organosulfur compound, (e) an inorganic filler, (f) an organic peroxide, and optionally, (g) an antioxidant. The hot-molded product has a difference in JIS-C hardness between the center and surface thereof of up to 15 units. The composition and hardness characteristics of the hot-molded product provide the golf ball with a solid comfortable feel upon impact and an excellent rebound.

21 Claims, No Drawings

GOLF BALL

BACKGROUND OF THE INVENTION

1. Field of the Invention

The present invention relates to a golf ball having a solid comfortable feel when hit with a golf club and good rebound characteristics.

2. Prior Art

Various improvements are being made in formulating the polybutadiene used as the base rubber in golf balls so as to confer the balls with outstanding rebound characteristics.

For example, JP-A 62-89750 describes rubber compositions for use as the base rubber in solid golf balls, which compositions are arrived at by blending a polybutadiene having a Mooney viscosity of 70 to 100 and synthesized using a nickel or cobalt catalyst with another polybutadiene having a Mooney viscosity of 30 to 90 and synthesized using a lanthanide catalyst or polybutadiene having a Mooney viscosity of 20 to 50 and synthesized using a nickel or cobalt catalyst.

However, further improvements are required in the above art to achieve golf balls endowed with a sufficiently solid comfortable feel and excellent rebound.

JP-A 2-268778 describes golf balls molded using a blend composed of a polybutadiene having a Mooney viscosity of less than 50 and synthesized using a Group VIII catalyst in combination with a polybutadiene having a Mooney viscosity of less than 50 and synthesized with a lanthanide catalyst. However, golf balls having both a solid comfortable feel and excellent rebound cannot be obtained in this way.

The existing art also teaches multi-piece solid golf balls in which an intermediate layer is formed of a low-Mooney viscosity polybutadiene (JP-A 11-70187), solid golf balls molded from rubber compositions comprising a polybutadiene having a Mooney viscosity of 50 to 69 and synthesized using a nickel or cobalt catalyst in combination with a polybutadiene having a Mooney viscosity of 20 to 90 and synthesized using a lanthanide catalyst (JP-A 11-319148), solid golf balls molded from compositions based on a rubber having a 1,2 vinyl content of at most 2.0% and a weight-average molecular weight to number-average molecular weight ratio Mw/Mn of not more than 3.5 (JP-A 11-164912), golf balls molded from rubber compositions containing a high Mooney viscosity polybutadiene (JP-A 63-275356), and golf balls molded from rubber compositions comprising polybutadiene having a high number-average molecular weight in admixture with polybutadiene having a low number-average molecular weight (JP-A 3-151985). However, none of these prior-art golf balls truly achieve both a solid comfortable feel upon impact and excellent rebound characteristics.

SUMMARY OF THE INVENTION

It is therefore an object of the present invention to provide golf balls which are endowed with both a solid comfortable feel when hit with a golf club and excellent rebound characteristics.

The inventor has discovered that golf balls containing as an essential component a hot-molded product which is made of a rubber composition formulated from a particular type of base rubber combined in specific proportions with certain other materials and which is endowed with specific hardness properties exhibit a good synergy of effects owing to optimization of the composition and hardness. Golf balls containing such a hot-molded product have a solid comfortable feel upon impact and outstanding rebound characteristics.

Accordingly, the invention provides a golf ball containing a hot-molded product of a rubber composition comprising 100 parts by weight of a base rubber composed of (a) 20 to 100 wt % of a polybutadiene having a cis-1,4 content of at least 60% and a 1,2 vinyl content of at most 2%, having a viscosity $\eta$ at 25° C. as a 5 wt % solution in toluene of up to 600 mPa·s, and satisfying the relationship: $10B+5 \leqq A \leqq 10B+60$, wherein A is the Mooney viscosity ($ML_{1+4}$ (100° C.)) of the polybutadiene and B is the ratio Mw/Mn between the weight-average molecular weight Mw and the number-average molecular weight Mn of the polybutadiene, in combination with (b) 0 to 80 wt % of a diene rubber other than component (a), (c) 10 to 60 parts by weight of an unsaturated carboxylic acid and/or a metal salt thereof, (d) 0.1 to 5 parts by weight of an organosulfur compound, (e) 5 to 80 parts by weight of an inorganic filler, (f) 0.1 to 5 parts by weight of an organic peroxide, and (g) 0 to 5 parts by weight of an antioxidant.

The hot-molded product has a difference in JIS-C hardness between the center and surface thereof of up to 15 JIS-C hardness units.

Preferably, the polybutadiene (a) is synthesized using a rare-earth catalyst and satisfies the relationship: $\eta \geqq 20A-600$ ($\eta$ and A being as defined above).

The base rubber typically contains as component (b) a polybutadiene synthesized with a Group VIII catalyst and having a Mooney viscosity of not more than 55.

DETAILED DESCRIPTION OF THE INVENTION

The golf ball of the invention includes as a constituent component a hot-molded product of a rubber composition in which the base rubber is polybutadiene. It is critical that the base rubber contain as component (a) a specific amount of polybutadiene in which the cis-1,4 and 1,2 vinyl contents, the viscosity $\eta$ at 25° C. as a 5 wt % solution in toluene, and the relationship between the Mooney viscosity and the polydispersity index Mw/Mn have each been optimized. Optimization of the relationship between the Mooney viscosity and the above viscosity $\eta$ is also desirable.

That is, the polybutadiene (a) has a cis-1,4 content of at least 60%, preferably at least 80%, more preferably at least 90%, and most preferably at least 95%; and has a 1,2 vinyl content of at most 2%, preferably at most 1.7%, more preferably at most 1.5%, and most preferably at most 1.3%. Outside of the above ranges, the rebound characteristics of the golf ball decline.

The polybutadiene (a) must also have a viscosity $\eta$ at 25° C. as a 5 wt % solution in toluene of not more than 600 mPa·s. "Viscosity $\eta$ at 25° C. as a 5 wt % solution in toluene" refers herein to the value in mPa·s units obtained by dissolving 2.28 g of the polybutadiene to be measured in 50 ml of toluene and carrying out measurement with a specified viscometer at 25° C. using a standard solution for the viscometer (JIS Z8809).

The polybutadiene (a) has a viscosity $\eta$ at 25° C. as a 5 wt % solution in toluene of not more than 600 mPa·s, preferably not more than 550 mPa·s, more preferably not more than 500 mPa·s, even more preferably not more than 450 mPa·s, and most preferably not more than 400 mPa·s. Too high a viscosity $\eta$ lowers the workability of the rubber composition. It is recommended that the viscosity $\eta$ be at least 50 mPa·s, preferably at least 100 mPa·s, more preferably at least 150 mPa·s, and most preferably at least 200 mPa·s. Too low a viscosity η may lower rebound characteristics.

In addition, the polybutadiene (a) must satisfy the relationship:

$$10B+5 \leqq A \leqq 10B+60,$$

wherein A is the Mooney viscosity ($ML_{1+4}$ (100° C.)) of the polybutadiene and B is the ratio Mw/Mn between the weight-average molecular weight Mw and the number-average molecular weight Mn of the polybutadiene. A is preferably at least 10B+7, more preferably at least 10B+8 and most preferably at least 10B+9, but preferably not more than 10B+55, more preferably not more than 10B+50, and most preferably not more than 10B+45. If A is too low, rebound characteristics decline. On the other hand, if A is too high, the workability of the rubber composition worsens.

It is also desirable for the polybutadiene (a) to satisfy the relationship:

$$20A-600 \leqq \eta \leqq 20A-100,$$

wherein η and A are as defined above. The viscosity η is preferably at least 20A−580, more preferably at least 20A−560, and most preferably at least 20A−540, but preferably not more than 20A−150, more preferably not more than 20A−200, and most preferably not more than 20A−250. The use of a polybutadiene having an optimized relationship of η and A, that suggests the high linearity of polybutadiene molecules, is effective for conferring better resilience.

It is recommended as well that the polybutadiene (a) have a Mooney viscosity ($ML_{1+4}$ (100° C.)) of at least 20, preferably at least 30, more preferably at least 40, and most preferably at least 50, but not more than 80, preferably not more than 70, more preferably not more than 65, and most preferably not more than 60.

The term "Mooney viscosity" used herein refers in each case to an industrial index of viscosity as measured with a Mooney viscometer, which is a type of rotary plastometer (see JIS K6300). This value is represented by the symbol $ML_{l+4}$ (100° C.), wherein "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

It is desirable for the polybutadiene (a) to be synthesized with a rare-earth catalyst. A known rare-earth catalyst may be used for this purpose.

Examples of suitable catalysts include lanthanide series rare-earth compounds, organoaluminum compounds, alumoxane, halogen-bearing compounds, optionally in combination with Lewis bases.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon residue of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

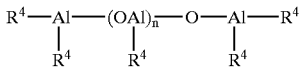

(I)

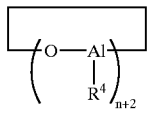

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon residue of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$ (wherein "Me" stands for methyl); and other metal halides such as silicon tetrachloride, tin tetrachloride and titanium tetrachloride.

The Lewis base may be used to form a complex with the lanthanide series rare-earth compound. Illustrative examples include acetylacetone and ketone alcohols.

In the practice of the invention, the use of a neodymium catalyst composed in part of a neodymium compound as the lanthanide series rare-earth compound is advantageous because it enables a polybutadiene rubber having a high cis-1,4 content and a low 1,2 vinyl content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of generally −30° C. to +150° C., and preferably 10° C. to 100° C.

It is also possible for the polybutadiene (a) to be obtained by polymerization with the above-described rare-earth catalyst, followed by the reaction of an end group modifier with active end groups on the polymer.

Any known end group modifier may be used. Examples include compounds of types (1) to (6) described below:

(1) halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain a carbonyl or ester moiety as a side chain; M' is a tin atom, silicon atom, germanium atom or phosphorus atom; X is a halogen atom; and n is an integer from 0 to 3);

(2) heterocumulene compounds containing on the molecule a Y═C═Z linkage (wherein Y is a carbon atom, oxygen atom, nitrogen atom or sulfur atom; and Z is an oxygen atom, nitrogen atom or sulfur atom);

(3) three-membered heterocyclic compounds containing on the molecule the following bonds

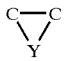

(wherein Y is an oxygen atom, a nitrogen atom or a sulfur atom);

(4) halogenated isocyano compounds;

(5) carboxylic acids, acid halides, ester compounds, carbonate compounds or acid anhydrides of the formulas $R^8$—$(COOH)_m$, $R^9(COX)_m$, $R^{10}$—(COO—$R^{11}$), $R^{12}$—OCOO—$R^{13}$, $R^{14}$—(COOCO—$R^{15}$)$_m$ or the following formula

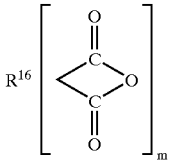

(wherein $R^8$ to $R^{16}$ are each independently a hydrocarbon group of 1 to 50 carbons; X is a halogen atom; and m is an integer from 1 to 5); and (6) carboxylic acid metal salts of the formula $R^{17}{}_lM''(OCOR^{18})_{4-l}$, $R^{19}{}_lM''(OCO—R^{20}—COOR^{21})_{4-l}$ or the following formula

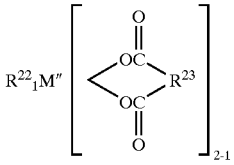

(wherein $R^{17}$ to $R^{23}$ are each independently a hydrocarbon group of 1 to 20 carbons, M" is a tin atom, a silicon atom or a germanium atom; and l is an integer from 0 to 3).

Illustrative examples of the end group modifiers of types (1) to (6) above and methods for their reaction are described in, for instance, JP-A 11-35633 and JP-A 7-268132.

In the practice of the invention, component (a) is included in the base rubber in an amount of at least 20 wt %, preferably at least 25 wt %, more preferably at least 30 wt %, and most preferably at least 35 wt %. The upper limit is 100 wt %, preferably not more than 90 wt %, more preferably not more than 80 wt %, and most preferably not more than 70 wt %. Too little component (a) in the base rubber makes it difficult to obtain a golf ball endowed with good rebound.

Component (b) in the base rubber is not an essential constituent of the rubber composition used in working the invention. Rather, it is an optional constituent which may be included so long as the objects of the invention are attainable. Specific examples of component (b) include polybutadiene rubber (BR), styrene-butadiene rubber (SBR), natural rubber, polyisoprene rubber, and ethylene-propylene-diene rubber (EPDM). Any one or combination of two or more thereof may be used. To confer good rebound and processability such as ease of extrusion, it is advantageous to include as component (b) a polybutadiene other than that of component (a) which has a Mooney viscosity of at least 10, preferably at least 20, more preferably at least 25, and most preferably at least 30, but not more than 55, preferably not more than 50, more preferably not more than 47, and most preferably not more than 45.

In the practice of the invention, it is recommended that the polybutadiene serving as component (b) be one that has been synthesized using a Group VIII catalyst. Exemplary Group VIII catalysts include nickel catalysts and cobalt catalysts.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complexes. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include the following composed of cobalt or cobalt compounds: Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use the above in combination with a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkyl aluminum sesquichloride such as ethylaluminum sesquichloride; or aluminum chloride.

Polymerization using the Group VIII catalysts described above, and especially a nickel or cobalt catalyst, can generally be carried out by a process in which the catalyst is continuously charged into the reactor together with the solvent and butadiene monomer, and the reaction conditions are suitably selected from a temperature range of 5 to 60° C. and a pressure range of atmospheric pressure to 70 plus atmospheres, so as to yield a product having the above-indicated Mooney viscosity.

The base rubber in the rubber composition includes above-described component (b) in an amount of at least 0 wt %, preferably at least 10 wt %, more preferably at least 20 wt %, and most preferably at least 30 wt %, but not more than 80 wt %, preferably not more than 75 wt %, more preferably not more than 70 wt %, and most preferably not more than 65 wt %. In the practice of the invention, component (b) is an optional component, meaning that the objects of the invention can be achieved without its use. However, by including component (b) within the foregoing range, even better characteristics can be conferred, such as better extrudability and improved workability during golf ball manufacture.

The hot-molded product of the invention is molded from a rubber composition containing as essential components specific amounts of (c) an unsaturated carboxylic acid and/or metal salt thereof, (d) an organosulfur compound, (e) an inorganic filler, (f) an organic peroxide and optionally, (g) an antioxidant per 100 parts by weight of the base rubber. The antioxidant (g) is optional, meaning that the objects of the invention are achievable in the absence of the antioxidant (g). However, the inclusion of antioxidant (g) provides a more appropriate hardness distribution.

Specific examples of unsaturated carboxylic acids that may be used as component (c) include acrylic acid, methacrylic acid, maleic acid and fumaric acid. Acrylic acid and methacrylic acid are especially preferred.

Specific examples of unsaturated carboxylic acid metal salts that may be used as component (c) include the zinc and magnesium salts of unsaturated fatty acids such as zinc methacrylate and zinc acrylate. Zinc acrylate is especially preferred.

The unsaturated carboxylic acid and/or metal salt thereof used as component (c) is included in an amount, per 100 parts by weight of the base rubber, of at least 10 parts by weight, preferably at least 15 parts by weight, and most preferably at least 20 parts by weight, but not more than 60 parts by weight, preferably not more than 50 parts by weight, more preferably not more than 45 parts by weight, and most preferably not more than 40 parts by weight. Too much component (c) makes the golf ball too hard, resulting in a feel upon impact that is difficult for the player to endure. On the other hand, too little component (c) undesirably lowers rebound characteristics.

The organosulfur compound (d) of the rubber composition is essential for imparting good rebound characteristics to the golf ball. Exemplary organosulfur compounds include thiophenol, thionaphthol, halogenated thiophenols, and metal salts thereof. Specific examples include pentachlorothiophenol, pentafluorothiophenol, pentabromothiophenol, p-chlorothiophenol, and zinc salts thereof, such as the zinc salt of pentachlorothiophenol; and organosulfur compounds having 2 to 4 sulfurs, such as diphenylpolysulfides, dibenzylpolysulfides, dibenzoylpolysulfides, dibenzothiazoylpolysulfides and dithiobenzoylpolysulfides. Diphenyldisulfide and the zinc salt of pentachlorothiophenol are especially preferred.

The organosulfur compound (d) is included in an amount, per 100 parts by weight of the base rubber, of at least 0.1 part by weight, preferably at least 0.2 part by weight, and most preferably at least 0.5 part by weight, but not more than 5 parts by weight, preferably not more than 4 parts by weight, more preferably not more than 3 parts by weight, and most preferably not more than 2 parts by weight. Too much organosulfur compound results in an excessively low hardness, whereas too little makes it impossible to enhance rebound characteristics.

Examples of inorganic fillers that may be used as component (e) include zinc oxide, barium sulfate and calcium carbonate. The inorganic filler (e) is included in an amount, per 100 parts by weight of the base rubber, of at least 5 parts by weight, preferably at least 7 parts by weight, more preferably at least 10 parts by weight, and most preferably at least 13 parts by weight, but not more than 80 parts by weight, preferably not more than 50 parts by weight, more preferably not more than 45 parts by weight, and most preferably not more than 40 parts by weight. Too much or too little inorganic filler makes it impossible to achieve a golf ball having an appropriate weight and good rebound characteristics.

The organic peroxide (f) may be a commercial product, suitable examples of which include Percumil D (manufactured by NOF Corporation), Perhexa 3M (manufactured by NOF Corporation) and Luperco 231XL (manufactured by Atochem Co.). If necessary, two or more different organic peroxides may be mixed and used together.

The organic peroxide (f) is included in an amount, per 100 parts by weight of the base rubber, of at least 0.1 part by weight, preferably at least 0.3 part by weight, more preferably at least 0.5 part by weight, and most preferably at least 0.7 part by weight, but not more than 5 parts by weight, preferably not more than 4 parts by weight, more preferably not more than 3 parts by weight, and most preferably not more than 2 parts by weight. Too much or too little organic peroxide makes it impossible to achieve a ball having a good hardness distribution, i.e., solid comfortable feel upon impact, good durability and rebound characteristics.

If necessary, the rubber composition may also include (g) an antioxidant, suitable examples of which include such commercial products as Nocrac NS-6, Nocrac NS-30 (both made by Ouchi Shinko Chemical Industry Co., Ltd.), and Yoshinox 425 (made by Yoshitomi Pharmaceutical Industries, Ltd.). The antioxidant is used in an amount, per 100 parts by weight of the base rubber, of at least 0 part by weight, preferably at least 0.05 part by weight, more preferably at least 0.1 part by weight, and most preferably at least 0.2 part by weight, but not more than 3 parts by weight, preferably not more than 2 parts by weight, more preferably not more than 1 part by weight, and most preferably not more than 0.5 part by weight. Too much antioxidant makes it impossible to achieve a ball having a good hardness distribution, i.e., solid feel upon impact, good durability and rebound characteristics.

The hot-molded product can be produced by vulcanizing and curing the above-described rubber composition at a temperature of 100 to 200° C. for a period of 10 to 60 minutes. If desired, two stages of vulcanization may be employed.

In the practice of the invention, it is critical for the hot-molded product to have a hardness difference, expressed as the JIS-C hardness at the surface of the molded product minus the JIS-C hardness at the center of the molded product, of not more than 15, preferably not more than 13, more preferably not more than 11, even more preferably not more than 9, and most preferably not more than 7 JIS-C hardness units, but at least 0, preferably at least 1, more preferably at least 2, even more preferably at least 3, further preferably at least 4, and most preferably at least 5 JIS-C hardness units. The hardness adjustment of the hot-molded product, combined with the aforementioned optimization of the material itself, endows a golf ball with both a solid comfortable feel upon impact and good rebound characteristics can be reliably obtained.

It is recommended that the foregoing hot-molded product, regardless of which of the subsequently described golf ball constructions in which it is used, have a deflection, when subjected to a load of 980 N (100 kg), of at least 2.0 mm, preferably at least 2.5 mm, more preferably at least 2.8 mm, and most preferably at least 3.2 mm, but not more than 6.0 mm, preferably not more than 5.5 mm, more preferably not more than 5.0 mm, and most preferably not more than 4.5 mm. Too small a deformation may worsen the feel of the ball upon impact and, particularly on long shots such as with a driver in which the ball incurs a large deformation, may subject the ball to an excessive rise in spin, reducing the carry. On the other hand, if the hot-molded product is too soft, the golf ball tends to have a dead feel when hit, an inadequate rebound that results in a poor carry, and a poor durability to cracking with repeated impact.

The golf ball of the invention includes as an essential component the above-described hot-molded product, but the construction of the ball is not subject to any particular limitation. Examples of suitable golf ball constructions include one-piece golf balls in which the hot-molded product itself is used directly as the golf ball, two-piece solid golf balls wherein the hot-molded product serves as a solid core on the surface of which a cover has been formed, multi-piece solid golf balls made of three or more pieces in which the hot-molded product serves as a solid core over which a cover composed of two or more layers has been formed, and thread-wound golf balls in which the hot-molded product serves as the center core. The above-described characteristics of the hot-molded product can be most effectively exploited in two-piece solid golf balls and multi-piece solid golf balls in which it is used as the solid core.

In the practice of the invention, when the hot-molded product is used as a solid core in the manner described above, it is recommended that the solid core have a diameter of at least 30.0 mm, preferably at least 32.0 mm, more preferably at least 35.0 mm, and most preferably at least 37.0 mm, but not more than 41.0 mm, preferably not more than 40.5 mm, even more preferably not more than 40.0 mm, and most preferably not more than 39.5 mm. In particular, it is desirable for such a solid core in a two-piece solid golf ball to have a diameter of at least 37.0 mm, preferably at least 37.5 mm, even more preferably at least 38.0 mm, and most preferably at least 38.5 mm, but not more than 41.0 mm, preferably not more than 40.5 mm, and most preferably not more than 40.0 mm. Similarly, it is desirable for such a solid core in a three-piece solid golf ball to have a diameter of at least 30.0 mm, preferably at least 32.0 mm, more preferably at least 34.0 mm, and most preferably at least 35.0 mm, but not more than 40.0 mm, preferably not more than 39.5 mm, and most preferably not more than 39.0 mm.

It is also recommended that the solid core have a specific gravity of at least 0.9, preferably at least 1.0, and most preferably at least 1.1, but not more than 1.4, preferably not more than 1.3, and most preferably not more than 1.2.

When the golf ball of the invention is a two-piece solid golf ball or a multi-piece solid golf ball, use may be made of known cover and intermediate layer materials. These materials may be primarily composed of, for example, a thermoplastic or thermoset polyurethane elastomer, polyester elastomer, ionomer resin, polyolefin elastomer or mixture thereof. Any one or mixture of two or more thereof may be used, although the use of a thermoplastic polyurethane elastomer or ionomer resin is especially preferred.

Illustrative examples of thermoplastic polyurethane elastomers that may be used for the above purpose include commercial products in which the diisocyanate is an aliphatic or aromatic compound, such as Pandex T7298, Pandex T7295, Pandex T7890, Pandex TR3080, Pandex T8295 and Pandex T8290 (all manufactured by DIC Bayer Polymer, Ltd.). Illustrative examples of suitable commercial ionomer resins include Surlyn 6320 and Surlyn 8120 (both products of E. I. du Pont de Nemours and Co., Inc.), and Himilan 1706, Himilan 1605, Himilan 1855, Himilan 1601 and Himilan 1557 (all products of DuPont-Mitsui Polychemicals Co., Ltd.).

Together with the primary material described above, the cover material may include also, as an optional material, polymers (e.g., thermoplastic elastomers) other than the foregoing. Specific examples of polymers that may be included as optional constituents include polyamide elastomers, styrene block elastomers, hydrogenated polybutadienes and ethylene-vinyl acetate (EVA) copolymers.

Two-piece solid golf balls and multi-piece solid golf balls according to the invention can be manufactured by a known method. No particular limitation is imposed on the manufacturing method, although two-piece and multi-piece solid golf balls are preferably manufactured by employing a method in which the above-described hot-molded product is placed as the solid core within a given injection mold, following which a predetermined method is used to inject the above-described cover material over the core in the case of a two-piece solid golf ball, or to successively inject the above-described intermediate layer material and cover material in the case of a multi-piece solid golf ball. In some cases, the golf ball may be produced by molding the cover material under an applied pressure.

It is recommended that the intermediate layer in a multi-piece solid golf ball have a thickness of at least 0.5 mm, and preferably at least 1.0 mm, but not more than 3.0 mm, preferably not more than 2.5 mm, more preferably not more than 2.0 mm, and most preferably not more than 1.6 mm.

Moreover, in both two-piece solid golf balls and multi-piece solid golf balls, it is recommended that the cover have a thickness of at least 0.7 mm and preferably at least 1.0 mm, but not more than 3.0 mm, preferably not more than 2.5 mm, more preferably not more than 2.0 mm, and most preferably not more than 1.6 mm.

The golf ball of the invention can be manufactured for competitive use by imparting the ball with a diameter and weight which conform with the Rules of Golf; that is, a diameter of at least 42.67 mm and a weight of not more than 45.93 g. It is recommended that the diameter be no more than 44.0 mm, preferably no more than 43.5 mm, and most preferably no more than 43.0 mm; and that the weight be at least 44.5 g, preferably at least 45.0 g, more preferably at least 45.1 g, and most preferably at least 45.2 g.

The golf balls of the invention have a solid comfortable feel upon impact and excellent rebound characteristics.

EXAMPLES

The following examples and comparative examples are provided to illustrate the invention, and are not intended to limit the scope thereof.

Examples 1–6 & Comparative Examples 1–5

The core materials shown in Table 2 were formulated in the indicated amounts per 100 parts by weight of polybutadiene material composed of polybutadiene types (1) to (7) described below. The properties of each type of polybutadiene are shown in Table 1, and the relative proportions in which they were combined in each example are shown in Table 2. The rubber compositions thus constituted were blended in a kneader or on a roll mill, then pressure molded under the vulcanizing conditions shown in Table 2 to form solid cores. In Table 2, the dicumyl peroxide was Percumil D, the 1,1-bis(t-butylperoxy)-3,3-5-trimethylcyclohexane was Perhexa 3M (both produced by NOF Corporation), and the antioxidant was Nocrac NS-6 (produced by Ouchi Shinko Chemical Industry Co., Ltd.).

Types of Polybutadiene:

(1) BR01, made by JSR Corporation
(2) BR11, made by JSR Corporation
(3) UBE101, made by Ube Industries, Ltd.
(4) HCBN-4, an experimental grade of polybutadiene made by JSR Corporation
(5) HCBN-2, an experimental grade of polybutadiene made by JSR Corporation
(6) Experimental grade #9100081 made by Firestone
(7) Experimental grade #9100069 made by Firestone

TABLE 1

| Type | Catalyst | cis-1,4 content, % | 1,2-vinyl content, % | Mooney viscosity (A) | Mw/Mn (B) | η | 10B + 5 | 10B + 60 | 20A − 600 |
|---|---|---|---|---|---|---|---|---|---|
| Polybutadiene | | | | | | | | | |
| (1) | Ni | 96 | 2.5 | 44 | 4.2 | 150 | 47 | 102 | 280 |
| (2) | Ni | 96 | 2 | 44 | 4.4 | 270 | 49 | 104 | 280 |
| (3) | Co | 95 | 3 | 38 | 4.2 | 130 | 47 | 102 | 160 |
| (4) | Nd | 96 | 1.1 | 44 | 3.5 | 390 | 40 | 95 | 280 |
| (5) | Nd | 96 | 0.9 | 40 | 3.3 | 280 | 38 | 93 | 200 |
| (6) | Nd | 95 | 1.5 | 56 | 2.6 | 370 | 31 | 86 | 520 |
| (7) | Nd | 96 | 1.3 | 48 | 2.5 | 280 | 30 | 85 | 360 |

TABLE 2

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| Rubber formulation (pbw) | | | | | | | | | | | |
| (1) | | | | | 70 | | 50 | | | 50 | |
| (2) | | 30 | | 50 | | 50 | 50 | 30 | 30 | | 30 |
| (3) | | | 50 | | | | | | | 50 | |
| (4) | | | | | 30 | | | | | | |
| (5) | 100 | | 50 | 50 | | | | 70 | 70 | | 70 |
| (6) | | 70 | | | | | | | | | |
| (7) | | | | | | 50 | | | | | |
| Core formulation (pbw) | | | | | | | | | | | |
| Polybutadiene | 100 | 100 | 100 | 100 | 100 | 100 | 100 | 100 | 100 | 100 | 100 |
| Dicumyl peroxide | 1.4 | 1.4 | 1.4 | 1 | 1 | 1.4 | 1.4 | 1.4 | 1.4 | 0.8 | 0.8 |
| 1,1-Bis(t-butylperoxy)-3,3,5-trimethylcyclo-hexane | | | | | | | | | | 0.3 | 0.5 |
| Zinc oxide | 21 | 22 | 19.5 | 19 | 19.5 | 20.5 | 21 | 23.5 | 7.5 | 23.5 | 20.5 |
| Antioxidant | 0.2 | 0.2 | 0.2 | 0.2 | 0.2 | 0.2 | 0.2 | 0.2 | 0.1 | 0 | 0.1 |
| Zinc acrylate | 25 | 23 | 27 | 30 | 30 | 26 | 25 | 21 | 59 | 18 | 27 |
| Zinc salt of pentachlorothiophenol | 1 | 1 | 2 | 1 | 0.5 | 1 | 1 | 0 | 0 | 1 | 1 |
| Vulcanizing conditions | | | | | | | | | | | |
| Primary Temp. (° C.) | 135 | 135 | 140 | 140 | 135 | 140 | 140 | 140 | 135 | 160 | 190 |
| vulcanization Time (min) | 40 | 40 | 30 | 30 | 40 | 30 | 30 | 30 | 40 | 16 | 10 |
| Secondary Temp. (° C.) | 170 | 170 | | | 170 | | | | 170 | | |
| vulcanization Time (min) | 5 | 5 | | | 5 | | | | 5 | | |

The resulting solid cores were tested as described below to determine their deformation under 980 N (100 kg) loading and their rebound. The results are shown in Table 3.

Deformation Under 980 N Loading:

Measured as the deflection (mm) of the solid core when subjected to a load of 980 N (100 kg).

Rebound:

The initial velocity of the solid cores was measured with the same type of initial velocity instrument as used by the United States Golf Association (USGA). Each rebound value shown in Table 3 is the difference between the initial velocity of the solid core obtained in that particular example and the initial velocity of the solid core obtained in Comparative Example 2.

In each example, the resulting solid core was placed in a given mold and the same cover material (Himilan 1601/Himilan 1557=50/50) was injection-molded over the core, thereby producing identically shaped two-piece solid golf balls having a diameter of about 42.7 mm and a weight of about 45.3 g. The properties of the resulting golf balls were determined as described below. The results are shown in Table 3.

Golf Ball Properties:

The carry and total distance were measured when the ball was hit at a head speed of 40 m/s with a driver (No. 1 wood) mounted on a swing machine.

Feel:

The feel of the ball when actually shot with a driver (No. 1 wood) was rated by five professional and five top-caliber amateur golfers as "Very hard," "Solid" (solid and comfortable), "Good" or "Too soft." The rating assigned most often to a particular ball was used as that ball's overall rating.

Durability When Repeatedly Hit:

The durability of the ball was rated as "Good" or "Poor" based on the tendency of the ball to crack when repeatedly struck at a head speed of 40 m/s.

TABLE 3

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| Core properties | | | | | | | | | | | |
| Deflection (mm) under 980 N load | 3.8 | 4.1 | 4.0 | 3.5 | 3.6 | 4.1 | 3.9 | 4.0 | 1.6 | 4.8 | 4.0 |
| JIS-C hardness difference (surface hardness-center hardness) | 5 | 5 | 11 | 11 | 3 | 11 | 11 | 11 | 2 | 20 | 42 |
| Rebound (m/s) | +0.8 | +0.6 | +0.7 | +0.7 | +0.7 | +0.5 | +0.3 | 0 | +0.7 | +0.1 | 0 |
| Golf ball properties | | | | | | | | | | | |
| Carry (m) | 181.9 | 180.6 | 181.2 | 181.3 | 181.4 | 180.2 | 178.9 | 177.3 | 181.0 | 177.9 | 177.0 |
| Total distance (m) | 202.8 | 201.4 | 202.1 | 202.0 | 202.2 | 201.1 | 199.6 | 198.0 | 201.5 | 198.9 | 197.9 |
| Feel | solid | solid | good | good | solid | good | good | good | very hard | too soft | too soft, coreless |
| Durability to repeated impact | good | good | good | good | good | good | good | good | good | poor | poor |

Japanese Patent Application No. 2001-163215 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a solid core and a cover, said core being formed of a hot-molded product of a rubber composition comprising:

100 parts by weight of a base rubber composed of (a) 20 to 100 wt % of a polybutadiene having a cis-1,4 content of at least 60% and a 1,2 vinyl content of at most 2%, having a viscosity η at 25° C. as a 5 wt % solution in toluene of up to 600 mPa·s, and satisfying the relationship: $10B+5 \leqq A \leqq 10B+60$, wherein A is the Mooney viscosity ($ML_{1+4}$ (100° C.)) of the polybutadiene and B is the ratio Mw/Mn between the weight-average molecular weight Mw and the number-average molecular weight Mn of the polybutadiene, in combination with (b) 0 to 80 wt % of a diene rubber other than component (a), (c) 10 to 60 parts by weight of an unsaturated carboxylic acid or a metal salt thereof or both, (d) 0.1 to 5 parts by weight of an organosulfur compound, (e) 5 to 80 parts by weight of an inorganic filler, (f) 0.1 to 5 parts by weight of an organic peroxide, and (g) 0 to 5 parts by weight of an antioxidant;

wherein the hot-molded product has a difference in JIS-C hardness between the center and surface thereof of from 5 to 15 JIS-C hardness units and said solid core has a diameter of at least 37.0 mm, and said cover has a thickness of at least 0.7 mm and not more than 2.5 mm.

2. The golf ball of claim 1, wherein the polybutadiene (a) is synthesized using a rare-earth catalyst.

3. The golf ball of claim 1, wherein the polybutadiene (a) satisfies the relationship: $\eta \geqq 20A-600$.

4. The golf ball of claim 1, wherein the base rubber contains as component (b) a polybutadiene synthesized with a Group VIII catalyst and having a Mooney viscosity of not more than 55.

5. The golf ball of claim 1, wherein said organosulfur compound is selected from a group consisting of thiophenol, thionaphthol, halogenated thiophenols, and metal salts thereof.

6. The golf ball of claim 1, wherein the amount of said component (b) is at least 10 wt %.

7. The golf ball of claim 1, wherein the polybutadiene has a cis-1,4 content of at least 95%.

8. The golf ball of claim 1, wherein the viscosity η of the polybutadiene at 25° C. as a 5 wt % solution in toluene is up to 400 mPa·s.

9. The golf ball of claim 1, wherein A is not more than 10B+45.

10. The golf ball of claim 1, wherein the Mooney viscosity is at least 20, but not more than 80.

11. The golf ball of claim 1, wherein the Mooney viscosity is at least 50, but not more than 60.

12. The golf ball according to claim 2, wherein the catalyst is chosen from a group comprising lanthanide series rare-earth compounds, organoaluminum compounds, alumoxane, and halogen-bearing compounds.

13. The golf ball according to claim 2, wherein the catalyst is used in combination with Lewis bases.

14. The golf ball according to claim 1, wherein component (a) is included in the base rubber in an amount of at least 35 wt %, and not more than 70 wt %.

15. The golf ball according to claim 1, wherein component (b) contains at least one of polybutadiene rubber, styrene-butadiene rubber, natural rubber, polyisoprene rubber and ethylene-propylene-diene rubber.

16. The golf ball according to claim 1, wherein component (c) is chosen from a group comprising acrylic acid, methacrylic acid, maleic acid and fumaric acid.

17. The golf ball according to claim 1, wherein the organosulfur compound is included in an amount, per 100 parts by weight of the base rubber, of at least 0.5 by weight, but not more than 2 parts by weight.

18. The golf ball according to claim 1, wherein the inorganic filler is chosen from a group comprising zinc oxide, barium sulfate and calcium carbonate, and wherein the filler is included in an amount, per 100 parts by weight of the base rubber, of at least 13 parts by weight, but not more than 40 parts by weight.

19. The golf ball of claim 1, wherein the difference in JIS-C hardness between the center and surface in said hot-molded product is from 5 to 13 JIS-C, hardness units.

20. The golf ball of claim 1, wherein the difference in JIS-C hardness between the center and surface in said hot-molded product is from 5 to 9 JIS-C hardness units.

21. The golf ball of claim 1, wherein the difference in JIS-C hardness between the center and surface in said hot-molded product is from 5 to 7 JIS-C hardness units.

* * * * *